US011585288B1

(12) United States Patent
Chittenden et al.

(10) Patent No.: US 11,585,288 B1
(45) Date of Patent: Feb. 21, 2023

(54) CYLINDER HEAD ASSEMBLY AND AXIALLY LOCATED IGNITER SLEEVE FOR SAME

(71) Applicant: Caterpillar Inc., Peoria, IL (US)

(72) Inventors: Jonathan R Chittenden, West Lafayette, IN (US); Viorel Petrariu, Lafayette, IN (US); Curtis John Graham, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 17/531,077

(22) Filed: Nov. 19, 2021

(51) Int. Cl.
*F02F 1/24* (2006.01)
*F02F 11/00* (2006.01)

(52) U.S. Cl.
CPC ..... *F02F 1/242* (2013.01); *F02F 11/002* (2013.01)

(58) Field of Classification Search
CPC ..... F02F 1/242; F02F 11/002
See application file for complete search history.

(56) References Cited

U.S. PATENT DOCUMENTS 5,586,571 A * 12/1996 Guillermo ..... B25B 5/147 137/15.17
6,279,516 B1 * 8/2001 Haugen ..... F02F 1/4214 123/41.82 R
6,295,969 B1 10/2001 Kato et al.
8,365,689 B2 2/2013 Gruber et al.
8,544,450 B2 * 10/2013 Megel ..... F02F 1/242 123/169 CA
9,190,812 B2 11/2015 Miyashita et al.
9,382,887 B2 7/2016 Clark et al.
10,385,800 B2 * 8/2019 Hyde ..... F01P 3/16
10,468,856 B2 * 11/2019 Niessner ..... H01T 13/08
2001/0015601 A1 * 8/2001 Henkel ..... F01P 3/16 313/11.5
2016/0363094 A1 * 12/2016 Luft ..... F01P 3/16
2019/0186409 A1 6/2019 Holzhammer et al.

FOREIGN PATENT DOCUMENTS

CN 202142771 U 2/2012
CN 110985263 A 4/2020
WO 2018198951 A1 11/2018

* cited by examiner

*Primary Examiner* — Kurt Philip Liethen
(74) *Attorney, Agent, or Firm* — Brannon Sowers & Cracraft PC

(57) ABSTRACT

A cylinder head assembly includes a cylinder head having a top deck, a fire deck, and an igniter post extending upward from the fire deck. An igniter sleeve is within an igniter bore in the cylinder head and includes a locating surface clamped against an upward facing stop surface of the cylinder head. A tip coolant clearance is defined axially between a sleeve tip and the fire deck, and a body coolant clearance is defined peripherally between the igniter sleeve and the cylinder head and is continuously circumferential of the igniter sleeve axially between the sleeve tip and a coolant cavity formed in the cylinder head.

20 Claims, 3 Drawing Sheets

CYLINDER HEAD ASSEMBLY AND AXIALLY LOCATED IGNITER SLEEVE FOR SAME

TECHNICAL FIELD

The present disclosure relates generally to an igniter sleeve, and more particularly to locating and supporting an igniter sleeve in a cylinder head assembly.

BACKGROUND

Internal combustion engines are well-known and in widespread use throughout the world for diverse purposes such as vehicle propulsion, production of rotational power in a great many machines, and electrical power generation. Most modern internal combustion engines include a cylinder block having combustion cylinders therein, and a cylinder head that includes intake and exhaust conduits, and valves controlling the opening and closing of the intake and exhaust conduits. Depending upon the engine type, an igniter such as a sparkplug, a prechamber sparkplug or another prechamber ignition device, may be supported in the cylinder head. Spark-ignition technologies are often used in gaseous fuel or gasoline engines. The internal geometry of the cylinder head is commonly complex to provide multiple coolant passages for conveying a coolant through the cylinder head to dissipate heat from combustion, including dissipating heat from sparkplugs or other ignition devices.

Cylinder head geometry, materials, and construction generally, have been varied in many ways over the years in efforts to optimize cooling efficacy. Where components overheat, various problems in the nature of cracking, thermal fatigue, combustion problems, and even seizure of moving parts or melting of materials can occur. Poor cooling efficacy can limit the manner in which an engine can be operated, or enhance it if efficacy is high. Certain modern engines are desirably relatively power dense, and inferior capacity for heat rejection can limit the available engine power output, for example.

U.S. Pat. No. 10,385,800 to Hyde et al., commonly owned, is directed to a cylinder head assembly, cylinder head, and method. Hyde et al. propose a cylinder head assembly including an igniter mount and a sleeve abutting the igniter mount within an igniter bore, such that the sleeve and cylinder head form an igniter cooling passage or moat circumferential of the igniter mount. The disclosed configuration apparently improves heat dissipation and reduces likelihood of pre-ignition. While Hyde et al. may have various applications, there is always room for improvement and development of alternative strategies.

SUMMARY

In one aspect, a cylinder head assembly includes a cylinder head having a top deck, a fire deck, an igniter post extending upward from the fire deck, an upward facing stop surface arranged axially between the top deck and the fire deck, a coolant cavity formed between the top deck and the fire deck, and an igniter bore defining a bore center axis and including an upper bore section extending through the top deck, and a lower bore section formed in the igniter post. The cylinder head assembly further includes an igniter sleeve having an upper sleeve end within the upper bore section, a lower sleeve end positioned upon the igniter post and having a sleeve tip, and a locating surface clamped against the upward facing stop surface. A tip coolant clearance is defined axially between the sleeve tip and the fire deck and extends circumferentially around the igniter post. A body coolant clearance is defined peripherally between the igniter sleeve and the cylinder head, and the body coolant clearance is continuously circumferential of the igniter sleeve axially between the sleeve tip and the coolant cavity.

In another aspect, an igniter sleeve includes an elongate sleeve body defining a center axis extending between an upper sleeve end and a lower sleeve end having a sleeve tip. The elongate sleeve body includes a cylindrical body wall between the upper sleeve end and the lower sleeve end, a conical body wall within the lower sleeve end and having an inner igniter clamping surface, and a cylindrical tip wall forming a tip opening extending through the sleeve tip. The elongate sleeve body further includes a seal shoulder, and a seal groove formed adjacent to the seal shoulder and circumferential of the center axis, a locating surface axially between the seal shoulder and one of the upper sleeve end or the lower sleeve end and structured to clamp against an upward facing stop surface in a cylinder head, and a downward facing tool engagement surface.

In still another aspect, an igniter sleeve includes an elongate sleeve body defining a center axis extending between an upper sleeve end and a lower sleeve end including a sleeve tip. The elongate sleeve body includes a cylindrical body wall between the upper sleeve end and the lower sleeve end, a conical body wall adjoining the cylindrical body wall and located within the lower sleeve end, and a cylindrical tip wall adjoining the conical body wall and forming a tip opening extending through the sleeve tip. Each of the cylindrical body wall, the conical body wall, and the cylindrical tip wall is axisymmetric about the center axis. The elongate sleeve body further includes a peripheral shoulder, and a downward facing locating surface upon the peripheral shoulder.

DETAILED DESCRIPTION

Figure 1:
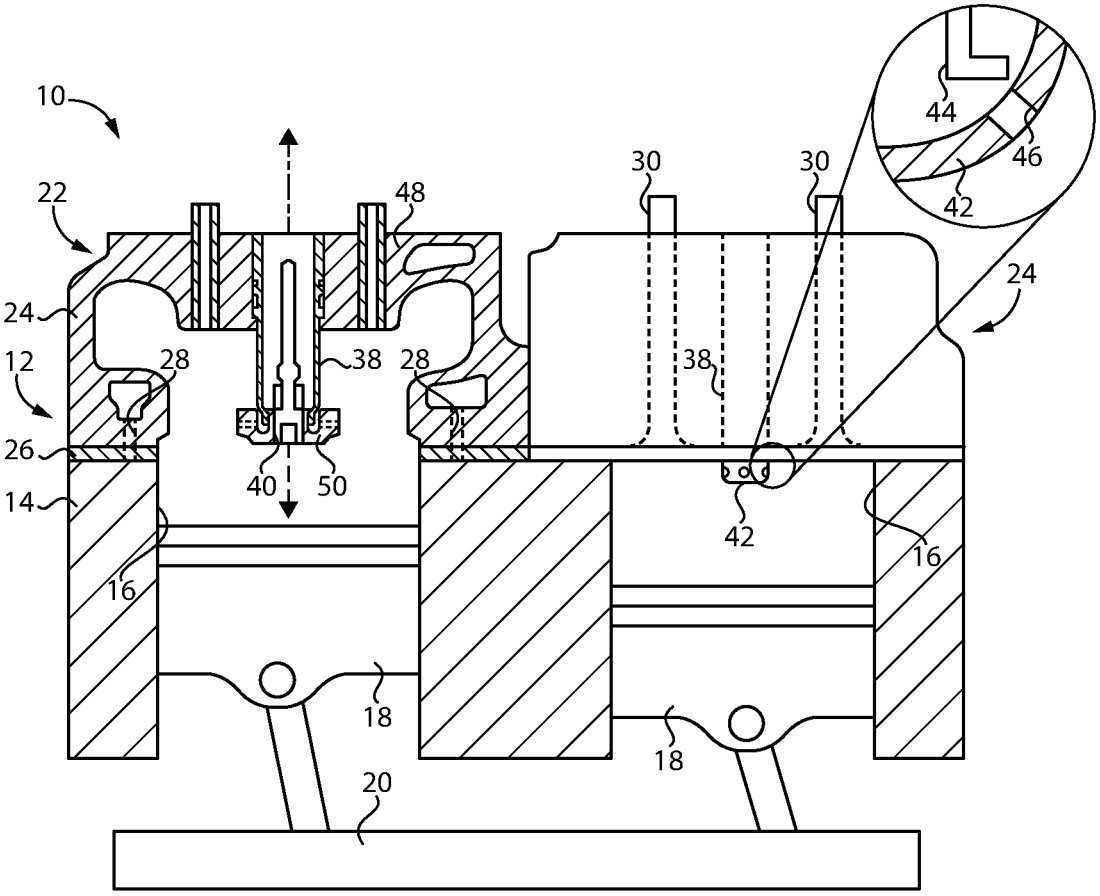
FIG. 1 is a partially sectioned side diagrammatic view of an internal combustion engine system, and including a detailed enlargement, according to one embodiment.

Referring to FIG. 1, there is shown an internal combustion engine system 10, according to one embodiment. Engine system 10 includes an engine 12 having an engine housing 14 with a plurality of combustion cylinders 16 formed therein. A plurality of pistons 18 are within cylinder 16 and coupled with a crankshaft 20 in a generally conventional manner. Cylinders 16 can include any number in any suitable arrangement such as an inline pattern, a V-pattern, or still another. Engine system 10 may further include a fuel supply (not shown) which may be a gaseous fuel supply having a stored volume of a gaseous fuel, such as cryogenically stored natural gas with attendant vaporization and pressurization equipment, a stored volume of pressurized gas, or various other gas supply configurations such as connections to a line gas supply or the like. Suitable gaseous fuels can include not only natural gas but also methane, ethane, mine gas, landfill gas, biogas, or still others. In other embodiments, engine system 10 could be a liquid fuel arrangement, a dual fuel arrangement, or still another. In a practical implementation strategy engine system 10 can be prechamber spark-ignited, however, other spark-ignition strategies or compression-ignition strategies could be employed in different embodiments. Engine system 10 can be deployed in any application, including for electrical power generation, operation of a pump or a compressor, or for vehicle propulsion, to name a few examples.

Engine 12 further includes a cylinder head assembly 22 attached to engine housing 14, and a head gasket 26 sandwiched between cylinder head assembly 22 and engine housing 14. Cylinder head assembly 22 includes a cylinder head 24 and may be one of a plurality of substantially identical cylinder heads 24 each associated with one cylinder 16. In other arrangements, cylinder head assembly 22 could include a slab cylinder head associated with multiple cylinders according to generally known configurations. Coolant channels 28 fluidly connect between engine housing 14 and cylinder head 24 to convey a flow of liquid engine coolant through cylinder head 24 for cooling of components therein. Engine valves 30 are supported in cylinder head 24, and are visible in the counterpart cylinder head assembly shown on the right side of the drawing in FIG. 1. Description and discussion herein of operation or structure of any one element in the singular should be understood to refer by way of analogy to similar elements in analogous components. Moreover, description or discussion of any one embodiment is to be understood to refer by way of analogy to any other embodiment except where stated otherwise or apparent from the context.

Engine valves 30 will typically be actuated to operate engine system 10 in a conventional four-cycle pattern, and in an implementation include two conventionally operated exhaust valves and two conventionally operated intake valves per cylinder, as will be familiar to those skilled in the art. As will be further apparent from the following description, engine system 10 generally, and cylinder head assembly 22 in particular, is uniquely configured for efficient installation and removal of certain components as well as improved cooling efficacy as compared to certain known designs.

Cylinder head assembly 22 further includes an igniter sleeve 38 having an igniter 40 supported therein. Igniter 40 may include a prechamber sparkplug igniter, having a prechamber tip 42 within cylinder 16 with one or more outlets 46 formed therein that communicate flame jets to cylinder 16 to ignite a main charge of fuel therein. A main gaseous fuel charge can be delivered by way of fumigation, port injection, direct injection, or combinations of these. One or more spark electrodes 44 are within prechamber tip 42 to produce a spark that ignites a mixture of fuel and air in prechamber tip 42. In a practical implementation, a prechamber ignition charge of fuel and air is pushed into prechamber tip 42 in response to movement of piston 18 toward a top dead center position in cylinder 16. In other embodiments, a prechamber sparkplug or other prechamber ignition device could be directly supplied with a fuel and/or air for prechamber ignition.

Figure 2:
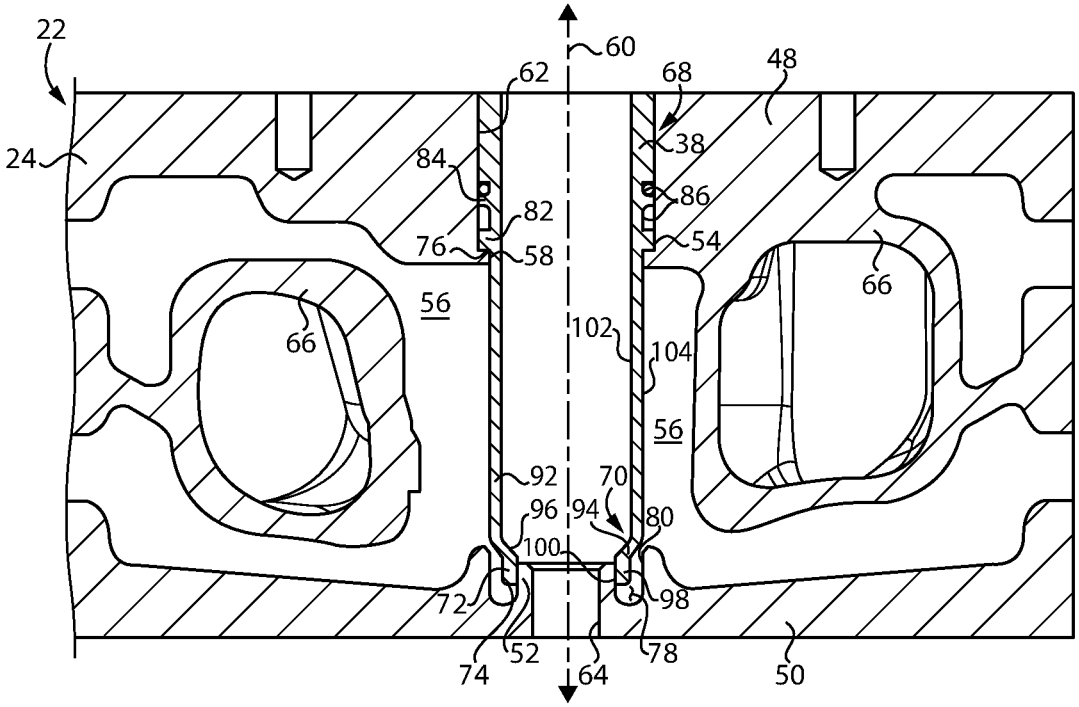
FIG. 2 is a sectioned view through a cylinder head assembly, according to one embodiment.

Referring also now to FIG. 2, cylinder head 24 includes a top deck 48, a fire deck 50, and an igniter post 52 extending upward from fire deck 50. Igniter post 52 supports and positions igniter sleeve 38, as further discussed herein. Cylinder head 24 further includes an upward facing stop surface 54 arranged axially between top deck 48 and fire deck 50. The term "axially" in this instance refers to directions along a common axis of cylinder head 24 and igniter sleeve 38, later described. Cylinder head 24 also includes a coolant cavity 56 formed between top deck 48 and fire deck 50, and an igniter bore 58 defining a bore center axis 60 and including an upper bore section 62 extending through top deck 48, and a lower bore section 64 formed in igniter post 52. A plurality of exhaust conduits 66 are also provided in cylinder head 24 and extend through coolant cavity 56 to intake and exhaust openings in fire deck 50 to enable an exchange of heat with coolant circulated therein. Igniter post 52 can include a generally cylindrical upwardly projecting protrusion formed by casting and/or machining in cylinder head 24 and centered on bore center axis 60. Igniter sleeve 38 may likewise be centered on bore center axis 60.

Figure 3:
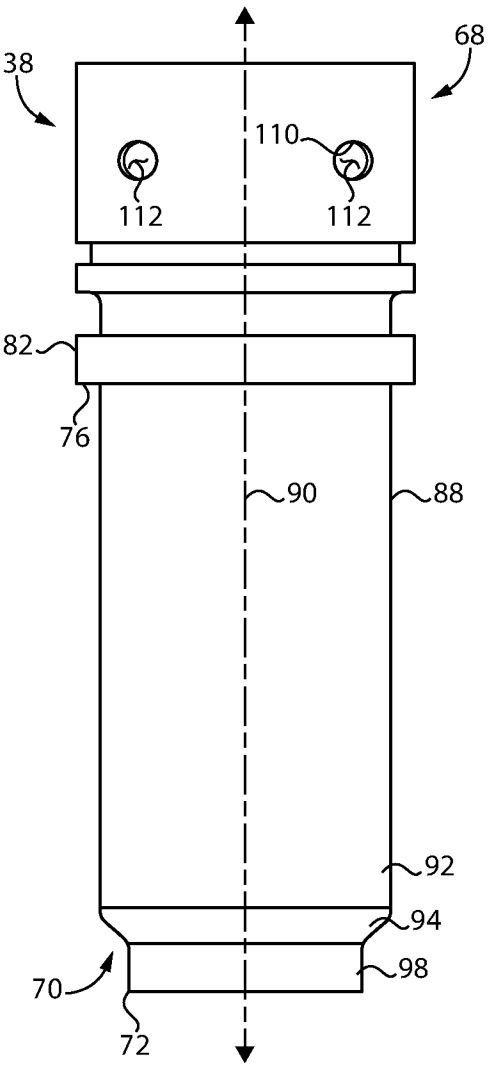
FIG. 3 is an elevational view of an igniter sleeve, according to one embodiment.

Referring also now to FIG. 3, igniter sleeve 38 includes an upper sleeve end 68 within upper bore section 62, and a lower sleeve end 70 positioned upon igniter post 52 and having a sleeve tip 72. Sleeve tip 72 includes a tip axial end surface 74. Igniter sleeve 38 is also understood to include an elongate sleeve body 88 defining a center axis 90 extending between upper sleeve end 68 and lower sleeve end 70 and colinear with bore center axis 60. Elongate sleeve body 88 may also include a cylindrical body wall 92 between upper sleeve end 68 and lower sleeve end 70, a conical body wall 94 within lower sleeve end 70 and adjoining cylindrical body wall 92, and having an igniter clamping surface 96 against which igniter 40 is clamped when cylinder head assembly 22 is assembled for service. Elongate sleeve body 88 may also include a cylindrical tip wall 98 adjoining conical body wall 94 and forming a tip opening 100 extending through sleeve tip 72, with cylindrical tip wall 98 positioned peripherally and circumferentially around igniter post 52. Cylindrical body wall 92, conical body wall 94, and cylindrical tip wall 98 may be axisymmetric about center axis 90. Cylindrical tip wall 98 may be interference-fitted with igniter post 52 in some embodiments, with the interference fit forming a combustion seal. During assembly, igniter sleeve 38 can be heated prior to installation upon igniter post 52 to enable formation of an interference fit by shrink fitting. Analogously igniter post 52 could be chilled prior to installation of igniter sleeve 38 thereon to facilitate formation of an interference fit, according to known principles.

Igniter sleeve 38 and elongate sleeve body 88, referred to at times interchangeably herein, may include an inner sleeve surface 102 sized and shaped to complimentarily accept igniter 40, and an outer sleeve surface 104, much of which is directly exposed to a flow of coolant through coolant cavity 56 as further discussed herein. Outer sleeve surface 104 and inner sleeve surface 102 are each in part upon cylindrical body wall 92, conical body wall 94, and cylindrical tip wall 98, and oriented parallel to one another upon the respective walls 92, 94 and 98. Igniter sleeve 38 further includes a locating surface 76 clamped against upward facing stop surface 54. Locating surface 76 defines an axial positioning of igniter sleeve 38 in cylinder head 24, such that igniter sleeve 38 can be installed downwardly into cylinder head 24 until locating surface 76 contacts upward facing stop surface 54 to establish a positioning of igniter sleeve 38 for service in cylinder head 24.

It can also be seen from FIG. 2 that a tip coolant clearance 78 is defined axially between sleeve tip 72 and fire deck 50 and extends circumferentially around igniter post 52. Tip coolant clearance 78 may form, or be part of, a coolant moat that enables coolant to flow in direct heat transference contact with igniter sleeve 38 and igniter post 52 to dissipate heat of fire deck 50, igniter 40, igniter post 52, and igniter sleeve 38. The flow of coolant into and through tip coolant clearance 78 can be an active pumped flow such as with dedicated coolant channels or holes opening to or near tip coolant clearance 78, or by way of passive flow based on fluid connection with coolant cavity 56. It can also be noted a body coolant clearance 80 is defined peripherally between igniter sleeve 38 and cylinder head 24. Body coolant clearance 80 may be continuously circumferential of igniter sleeve 38 axially between sleeve tip 72 and coolant cavity 56 in some embodiments to provide an unobstructed upward flow of coolant.

In the embodiment illustrated in FIGS. 1-3, locating surface 76 is a downward facing outer igniter sleeve surface, thus part of outer sleeve surface 104, and spaced axially from sleeve tip 72. In other embodiments locating surface 76 could be positioned elsewhere, and could be part of sleeve tip 72. Downward facing means generally facing a direction of fire deck 50, not necessarily directly or solely downward facing. Also in the embodiment illustrated in FIGS. 1-3 locating surface 76 engages with upward facing stop surface 54 formed in or near top deck 48. In other embodiments a mid-deck region could be provided in cylinder head 24 and could include an upward facing stop surface. In still other instances an upward facing stop surface could be formed near, or potentially as part of, fire deck 50. Body coolant clearance 80 fluidly connects tip coolant clearance 78 to other parts of coolant cavity 56 and thus enables coolant flow to be substantially in pervasive heat transference contact with outer surface 104 of igniter sleeve 38 vertically upward to such point at which outer surface 104 is obscured within or sealed from top deck 48 within upper bore section 62. It can also be noted in FIGS. 2 and 3 in particular that igniter sleeve 38 includes a peripheral shoulder 82 and locating surface 76 is formed on peripheral shoulder 82. Igniter sleeve 38 may also include one or more seal shoulders 84 defining one or more seal grooves 86 adjacent to respective seal shoulders 84. Seal grooves 86 may be equipped with O-ring seals, and peripheral shoulder 82 may be located axially between the one or more stop shoulders 84 and lower sleeve end 70. Depending upon the construction of an igniter sleeve a peripheral shoulder with a locating surface formed thereon may be located axially between one or more seal shoulders and an upper sleeve end.

Figure 4:
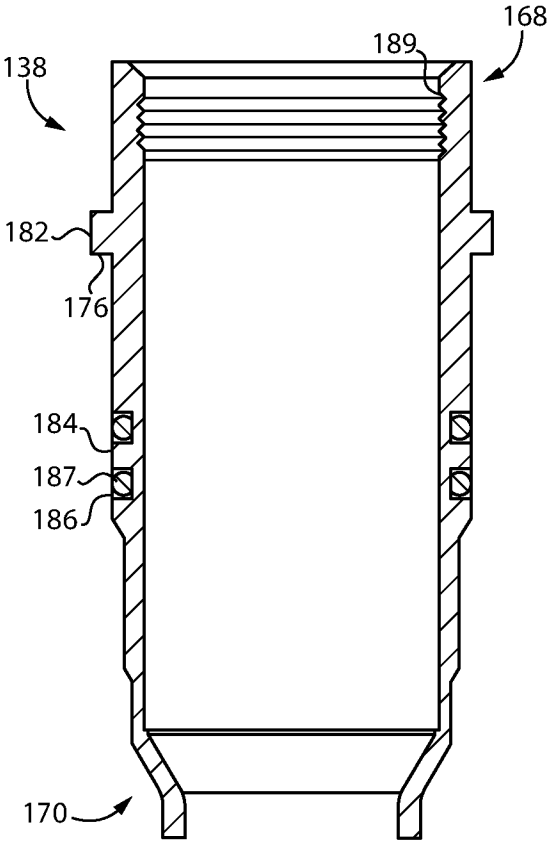
FIG. 4 is a sectioned view of an igniter sleeve, according to another embodiment.

Referring now to FIG. 4, there is shown an igniter sleeve 138 according to another embodiment, and including an upper sleeve end 168 and a lower sleeve end 170. Igniter sleeve 138 includes a locating surface 176 upon a peripheral shoulder 182. Igniter sleeve 138 also includes a seal shoulder 184 and a seal groove 186 formed adjacent to seal shoulder 184. An O-ring seal 187 is within seal groove 186. Igniter sleeve 138 also includes internal threads 189 functioning as tool engagement surfaces that can be engaged by a removal tool to withdraw igniter sleeve 138 from a cylinder head. In igniter sleeve 138 peripheral shoulder 182 is located axially between seal shoulder 184 and lower sleeve end 170. Internal threads 189 may include downward facing tool engagement surfaces as contemplated herein.

Figure 5:
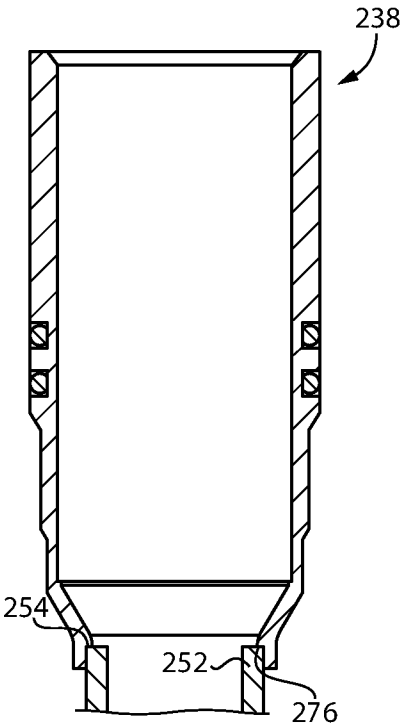
FIG. 5 is a sectioned view of an igniter sleeve, according to another embodiment.

Referring now to FIG. 5, there is shown an igniter sleeve 238 according to another embodiment. Igniter sleeve 238 includes a locating surface 276 that engages against a stop surface 254. Stop surface 254 is formed on igniter post 252. A suitable O-ring seal, another type of seal such as a gasket seal, or a metal-metal seal could be formed by or between locating surface 276 and stop surface 254.

Figure 6:
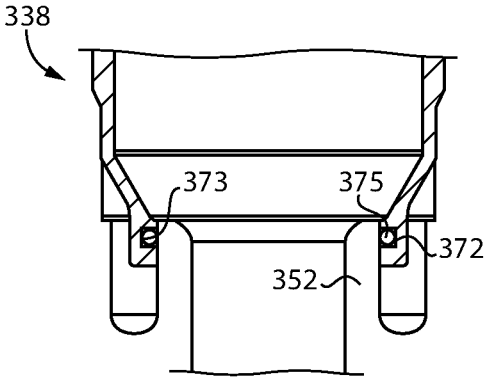
FIG. 6 is a sectioned view of an igniter sleeve, according to yet another embodiment.

Referring now to FIG. 6, there is shown an igniter sleeve 338 according to yet another embodiment. Igniter sleeve 338 includes a sleeve tip 372, and an inside seal groove 373 formed in an inner surface of sleeve tip 372. A sealing element 375, such as an O-ring seal, is between sleeve tip 372 and igniter post 352 and forms a combustion seal. Sealing element 375 can be understood as radially between sleeve tip 372 and igniter post 352, whereas in other embodiments a sealing element could be positioned axially between a respective sleeve tip and igniter post.

Figure 7:
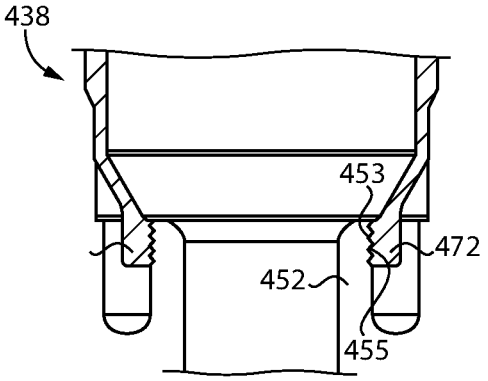
FIG. 7 is a sectioned view of an igniter sleeve, according to yet another embodiment.

Referring now to FIG. 7, there is shown an igniter sleeve 438 according to yet another embodiment. Igniter sleeve 438 includes a sleeve tip 472 positioned upon an igniter post 452, and engaged by way of internal threads 453 of sleeve tip 472 and external threads 455 of igniter post 452. In this embodiment igniter sleeve 438 can be threaded into engagement with igniter post 452, with a combustion seal being formed as a metal-metal seal between the threads of the respective components, or by way of a separate sealing element radially or axially between the respective components.

Figure 8:
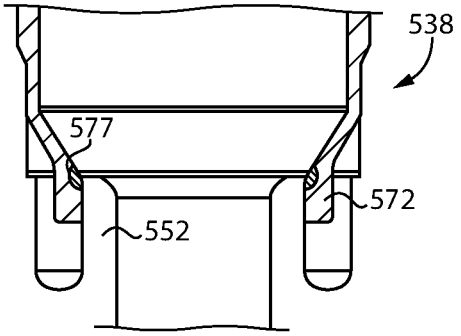
FIG. 8 is a sectioned view of an igniter sleeve, according to yet another embodiment.

Referring now to FIG. 8, there is shown an igniter sleeve 538 according to yet another embodiment. Igniter sleeve 538 is positioned upon an igniter post 452 and includes a sleeve tip 572 attached to and sealed with igniter post 552 by way of a weld 577. Weld 577 can include mixed solidified materials of igniter sleeve 538 and igniter post 552, such as may be achieved by laser welding or another type of welding peripherally around the mated interface of sleeve tip 572 and igniter post 552.

Figure 9:
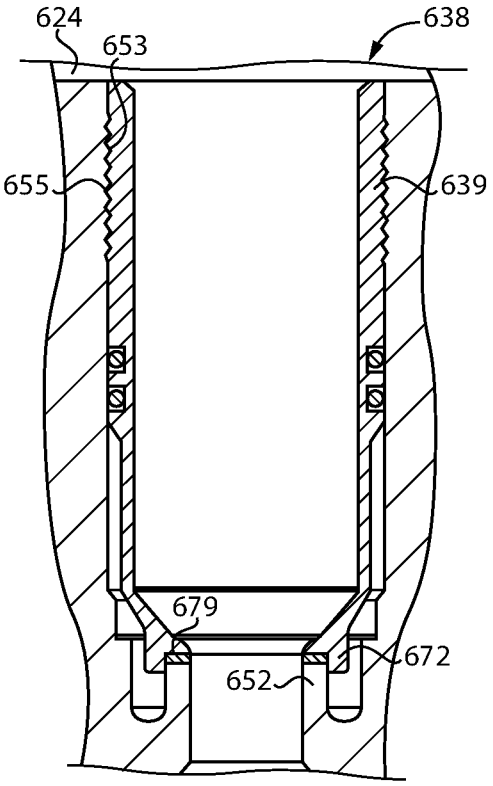
FIG. 9 is a sectioned view of an igniter sleeve, according to yet another embodiment.

Referring now to FIG. 9, there is shown an igniter sleeve 638 according to yet another embodiment. Igniter sleeve 638 includes an upper body section 639 having external threads 655 formed thereon. A cylinder head 624 includes internal threads 653 mated with external threads 655. An igniter post 652 of cylinder head 624 receives a sleeve tip 672, and a combustion seal 679 such as a gasket is sandwiched between igniter sleeve 638 and an igniter post 652. Engagement of internal threads 653 and external threads 655 clamps igniter sleeve 638 into cylinder head 624.

Figure 10:
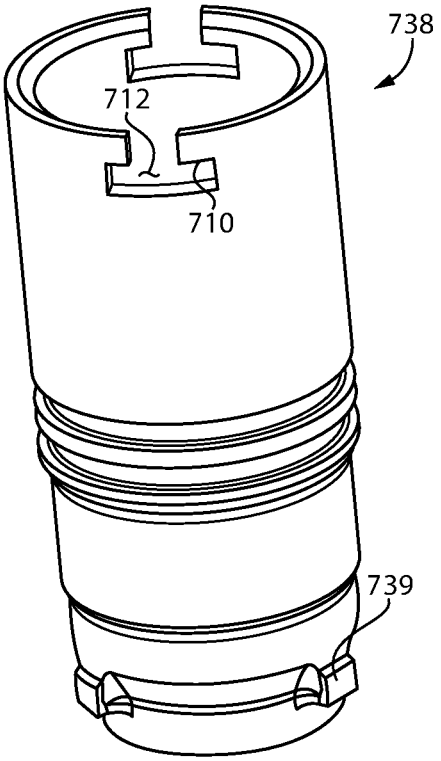
FIG. 10 is a diagrammatic view of an igniter sleeve, according to yet another embodiment.

Referring now to FIG. 10, there is shown an igniter sleeve 738 according to yet another embodiment. Igniter sleeve 738 includes a downward facing tool engagement surface 710. A slot 712 through a body wall (not numbered) is formed in part by downward facing tool engagement surface 710, extending between inner and outer surfaces of igniter sleeve 738. For disassembly, a removal tool can be positioned in slot 712 and engaged against downward facing tool engagement surface 710 such that upward force can be applied to igniter sleeve 738 and the same removed from a cylinder head. Slot(s) 712 could be T-shaped as shown, L-shaped, or have still another configuration. Igniter sleeve 738 also differs from other embodiments in that a plurality of protrusions 739 are formed thereon and structured to clamp against an upward facing stop surface in a cylinder head. Protrusions 739 thus can be understood to include locating surfaces functioning analogously to those described in other embodiments, but rather than a body coolant clearance continuously circumferential of igniter sleeve 738, a body coolant clearance would be discontinuous and interrupted by way of protrusions 739.

Referring back to FIG. 3, igniter sleeve 38 also includes downward facing tool engagement surfaces 110. In contrast to a slot arrangement, igniter sleeve 38 includes a hole 112 formed in part by downward facing tool engagement surfaces 110.

INDUSTRIAL APPLICABILITY

Referring to the drawings generally, but returning focus to the embodiment of FIGS. 1-3, during service engine system 10 will operate to convey gaseous fuel and air into each of cylinders 16. As each respective piston 18 moves toward a top dead center position in a compression stroke the respective engine valves 30 will be closed, enabling gaseous fuel and air to be urged into the respective prechamber tip 42. At a desired timing, spark electrode 44 is energized to produce an electrical spark that triggers ignition of the fuel and air in prechamber tip 42. Combustion of the fuel and air produces hot jets of combustion gases conveyed out through outlets 46 and into the respective cylinder 16 to trigger ignition of a main charge of gaseous fuel and air therein. Ignition and combustion of the main charge urges the respective piston 18 downward according to well known principles.

Also during operation, engine coolant is conveyed through coolant cavity 56, and caused to flow through tip coolant clearance 78, exchanging heat with materials of igniter post 52 and lower sleeve end 70. The coolant flows upward from tip coolant clearance 78 through body coolant clearance 80 into coolant cavity 56, and is thenceforth discharged from cylinder head 24 to return to a coolant tank typically by way of a heat exchanger or the like.

Known sparkplug sleeves employ various methods for sealing and assembly. Such known strategies typically suffer from a variety of drawbacks relating to cooling efficacy as well as installation and/or removal. The present disclosure provides an igniter sleeve configured where a positive stop is provided at a location that does not obstruct coolant flow into or out of a moat region around an igniter post. As described herein possible positive stop locations can be along upper body regions of an igniter sleeve, such as that specifically shown in the embodiments of FIGS. 1-3 and 4. In other embodiments, a positive stop location can be provided on an inner diameter region of an igniter sleeve, such as in the embodiments of FIGS. 7 and 9. Sealing between an igniter sleeve and a cylinder head may be accomplished by using O-ring grooves in the igniter sleeve or cylinder head, laser or friction welding, or a threaded interface. A downward load can be generated by applying a clamping load above an igniter using a clamp secured to a top deck surface, or by way of a threaded engagement between the igniter sleeve and the cylinder head as describe herein. Further, heating the igniter sleeve or freezing the cylinder head can reduce a required assembly force. Tool engagement surface features contemplated herein for removing an igniter sleeve for servicing or replacement can include holes, slots, internal or external ledges or shoulders, or threads, for example.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims. As used herein, the articles "a" and "an" are intended to include one or more items, and may be used interchangeably with "one or more." Where only one item is intended, the term "one" or similar language is used. Also, as used herein, the terms "has," "have," "having." or the like are intended to be open-ended terms. Further, the phrase "based on" is intended to mean "based, at least in part, on" unless explicitly stated otherwise.

What is claimed is:

1. A cylinder head assembly comprising:

a cylinder head including a top deck, a fire deck, an igniter post extending upward from the fire deck, an upward facing stop surface arranged axially between the top deck and the fire deck, a coolant cavity formed between the top deck and the fire deck, and an igniter bore defining a bore center axis and including an upper bore section extending through the top deck, and a lower bore section formed in the igniter post;

an igniter sleeve including an upper sleeve end within the upper bore section, a lower sleeve end positioned upon the igniter post and having a sleeve tip, and a locating surface clamped against the upward facing stop surface;

a tip coolant clearance is defined axially between the sleeve tip and the fire deck and extends circumferentially around the igniter post; and a body coolant clearance is defined peripherally between the igniter sleeve and the cylinder head, and the body coolant clearance is continuously circumferential of the igniter sleeve in an axial direction from the sleeve tip to the coolant cavity.

2. The cylinder head assembly of claim 1 wherein the locating surface includes an outer sleeve surface spaced axially from the sleeve tip.

3. The cylinder head assembly of claim 2 wherein the igniter sleeve includes a peripheral shoulder and the locating surface is formed on the peripheral shoulder.

4. The cylinder head assembly of claim 3 wherein the igniter sleeve includes a plurality of seal shoulders defining a plurality of seal grooves, and the peripheral shoulder is located axially between the plurality of seal shoulders and the lower sleeve end.

5. The cylinder head assembly of claim 1 wherein the upward facing stop surface is formed on the igniter post.

6. The cylinder head assembly of claim 1 wherein the igniter sleeve includes an upper body section having external threads formed thereon, and the cylinder head includes internal threads mated with the external threads.

7. The cylinder head assembly of claim 1 further comprising a sealing element between the sleeve tip and the igniter post and forming a combustion seal.

8. The cylinder head assembly of claim 7 wherein the sealing element includes an O-ring radially between the sleeve tip and the igniter post.

9. The cylinder head assembly of claim 1 wherein the igniter sleeve further includes a downward facing tool engagement surface.

10. The cylinder head assembly of claim 9 wherein the igniter sleeve further includes a body wall, and the downward facing tool engagement surface extends through the body wall.

11. The cylinder head assembly of claim 10 further comprising a hole through the body wall formed in part by the downward facing tool engagement surface.

12. The cylinder head assembly of claim 10 further comprising a slot through the body wall formed in part by the downward facing tool engagement surface.

13. An igniter sleeve comprising:

an elongate sleeve body defining a center axis extending between an upper sleeve end and a lower sleeve end including a sleeve tip;

the elongate sleeve body including a cylindrical body wall between the upper sleeve end and the lower sleeve end, a conical body wall within the lower sleeve end and having an inner igniter clamping surface, and a cylindrical tip wall forming an igniter opening extending through the sleeve tip; and the elongate sleeve body further including a seal shoulder and a seal groove formed adjacent to the seal shoulder and circumferential of the center axis, a locating surface axially between the seal shoulder and one of the upper sleeve end or the lower sleeve end and structured to clamp against an upward facing stop surface in a cylinder head, and a downward facing tool engagement surface located in the upper sleeve end and oriented normal to the center axis.

14. The igniter sleeve of claim 13 wherein the locating surface includes an outer sleeve surface spaced axially from the sleeve tip.

15. The igniter sleeve of claim 14 wherein the elongate sleeve body further includes a peripheral shoulder and the locating surface is formed on the peripheral shoulder.

16. The igniter sleeve of claim 14 wherein the elongate sleeve body further includes an upper body section having external threads formed thereon.

17. The igniter sleeve of claim 13 wherein the cylindrical tip wall includes an inside seal groove formed therein.

18. The igniter sleeve of claim 13 wherein the elongate sleeve body further includes a body wall, and the downward facing tool engagement surface extends through the body wall.

19. An igniter sleeve comprising:

an elongate sleeve body defining a center axis extending between an upper sleeve end and a lower sleeve end including a sleeve tip;

the elongate sleeve body including a cylindrical body wall between the upper sleeve end and the lower sleeve end, a conical body wall adjoining the cylindrical body wall and located within the lower sleeve end, and a cylindrical tip wall adjoining the conical body wall and forming an igniter opening extending through the sleeve tip, and each of the cylindrical body wall, the conical body wall, and the cylindrical tip wall is axisymmetric about the center axis; and the elongate sleeve body further including a seal shoulder, a peripheral shoulder located axially between the seal shoulder and the upper sleeve end, and a downward facing locating surface upon the peripheral shoulder and oriented normal to the center axis.

20. The igniter sleeve of claim 19 wherein the elongate sleeve body further includes an outer sleeve surface and an inner sleeve surface each upon the cylindrical body wall, the conical body wall, and the cylindrical tip wall, and a tool engagement surface extending between the outer sleeve surface and the inner sleeve surface.

* * * * *